US009211454B2

(12) United States Patent
Matsunaga

(10) Patent No.: US 9,211,454 B2
(45) **Date of Patent: *Dec. 15, 2015**

(54) GOLF CLUB SHAFT

(71) Applicant: DUNLOP SPORTS CO, LTD., Kobe, Hyogo (JP)

(72) Inventor: Kiyofumi Matsunaga, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 107 days.

This patent is subject to a terminal disclaimer.

(21) Appl. No.: 13/779,180

(22) Filed: Feb. 27, 2013

(65) Prior Publication Data

US 2013/0231201 A1 Sep. 5, 2013

(30) Foreign Application Priority Data

Feb. 29, 2012 (JP) ..... 2012-044423

(51) Int. Cl.
*A63B 53/10* (2015.01)
*A63B 59/00* (2015.01)

(52) U.S. Cl.
CPC ..... *A63B 53/10* (2013.01); *A63B 59/0074* (2013.01); *A63B 2209/02* (2013.01)

(58) Field of Classification Search
CPC ..... A63B 53/10; A63B 2209/023; A63B 59/0074
See application file for complete search history.

(56) References Cited

U.S. PATENT DOCUMENTS

| | | | | |
|---|---|---|---|---|
| 6,857,972 | B2 * | 2/2005 | Kumamoto | 473/319 |
| 7,338,386 | B2 * | 3/2008 | Nakajima | 473/319 |
| 7,500,922 | B2 * | 3/2009 | Takeuchi | 473/319 |
| 2010/0041492 | A1 * | 2/2010 | Rice et al. | 473/289 |

FOREIGN PATENT DOCUMENTS

JP 2004-201911 A 7/2004

* cited by examiner

*Primary Examiner* — Stephen Blau
(74) *Attorney, Agent, or Firm* — Birch Stewart Kolasch & Birch, LLP

(57) ABSTRACT

Provided is a golf club shaft. When a distance from a front end of the shaft to a center of gravity of the shaft is $L_G$ and when a full length of the shaft is $L_S$, $0.54 \leq L_G/L_S \leq 0.65$ is satisfied. A shaft weight is not larger than 55 g, and a torque value is not higher than 6.5.

5 Claims, 11 Drawing Sheets

GOLF CLUB SHAFT

TECHNICAL FIELD

The present invention relates to a golf club shaft.

BACHGROUND ART

For golfers, flight distance of a ball is one of the important factors when selecting a golf club. Therefore, hitherto, in order to extend the flight distance of the ball, various improvements have been made with regard to shapes and materials of elements forming a golf club.

However, in recent years, in order to enhance fairness of competition by suppressing excessive flight distance, there have been regulations set in the rule regarding rebound performance of a clubface, club length, and inertia moment of a head; and thereby it is becoming difficult to improve flight distance.

In such a situation, in view of the fact that initial velocity of a ball largely influences flight distance, there has been a proposal (for example, cf. Patent Literature 1) of extending the club length close to the upper limit regulated by the rule to increase head speed of a club.

CITATION LIST

Patent Literature

[PTL1] Japenese Laid-Open Patent Publication No. 2004-201911

SUMMARY OF INVENTION

Technical Problem

However, with the method of increasing head speed of a club by extending the club length, controllability of the head deteriorates as the length of the club becomes longer, and it becomes difficult to hit a ball at a sweet spot of the head. Thus, a ball smash factor deteriorates and initial velocity of a ball cannot be stably increased; and, as a result, flight distance of a ball cannot be improved.

In order to solve this, it is necessary to increase the smash factor by reducing the length of the club and increase initial velocity of the ball by increasing the head weight. However, simply increasing the head weight leads to a problem where ease of swinging the club decreases due to inertia moment of the club now becoming large.

Therefore, it is conceivable to move the center of gravity point of the shaft toward the butt side (hand side) in order to prevent the increase of inertia moment of the club without further increasing the club weight.

Although lowering the distribution amount of a prepreg on the front end portion of the shaft is conceivable as a technique for moving the center of gravity point of the shaft toward the butt side; doing so reduces flexural strength (T-point strength) at the front end. In this case, increasing the proportion of 0° layer of a PAN-based fiber as a prepreg in the front end portion is conceivable as means for increasing flexural strength at the front end; however, although doing so improves flexural strength, there is a problem now where torque becomes large and variability of a hit ball becomes large.

The present invention is made in view of such a situation, and an objective of the present invention is to provide a golf club shaft capable of extending ball flight distance while suppressing variability of a hit ball.

Solution to Problem (1) In a golf club shaft of the present invention, when a distance from a front end of the shaft to a center of gravity of the shaft is $L_G$ and when a full length of the shaft is $L_S$, $0.54 \leq L_G/L_S \leq 0.65$ is satisfied, a shaft weight is not larger than 55 g, and a torque value is not higher than 6.5.

In the golf club shaft of the present invention, when the distance from the front end of the shaft to the center of gravity point of the shaft is $L_G$ and when the full length of the shaft is $L_S$, $0.54 \leq L_G/L_S \leq 0.65$ is satisfied and the center of gravity of the shaft is on the hand side. Therefore, when the weight of the head is increased in order to increase initial velocity of a ball, it is possible to suppress an increase in inertia moment of the club. As a result, the club becomes easy to swing, and it becomes possible to improve the smash factor and improve the flight distance of the ball. In addition, since the torque value is not higher than 6.5, directionality of a ball improves and variability of a hit ball becomes small.

(2) In the golf club shaft of the above (1), with regard to mass proportion of a prepreg used within a range 300 mm from a tip end, preferably, 15 to 25 mass % thereof is a prepreg of a pitch-based fiber and 75 to 85 mass % thereof is a prepreg of a PAN-based fiber.

(3) In the golf club shaft of the above (2), with regard to the PAN-based fiber, preferably, not less than 50 mass % thereof is a 0° layer and not less than 15 mass % thereof is a 45° layer.

(4) In the golf club shaft of the above (1), with regard to proportion of a bias layer occupying a front end part, a center part, and a back end part of the shaft, front end part<center part≤back end part is preferably satisfied.

(5) In the golf club shaft of the above (4), the proportion of the bias layer in the front end part, the center part, and the back end part of the shaft may be set as 20 to 35 mass %, 30 to 45 mass %, and 30 to 45 mass %, respectively.

Advantageous Effects of Invention

With the golf club shaft of the present invention, it is possible to extend ball flight distance while suppressing variability of a hit ball.

DESCRIPTION OF EMBODIMENTS

In the following, embodiments of a golf club shaft of the present invention will be described in detail with reference to the accompanying drawings.

Figure 1:
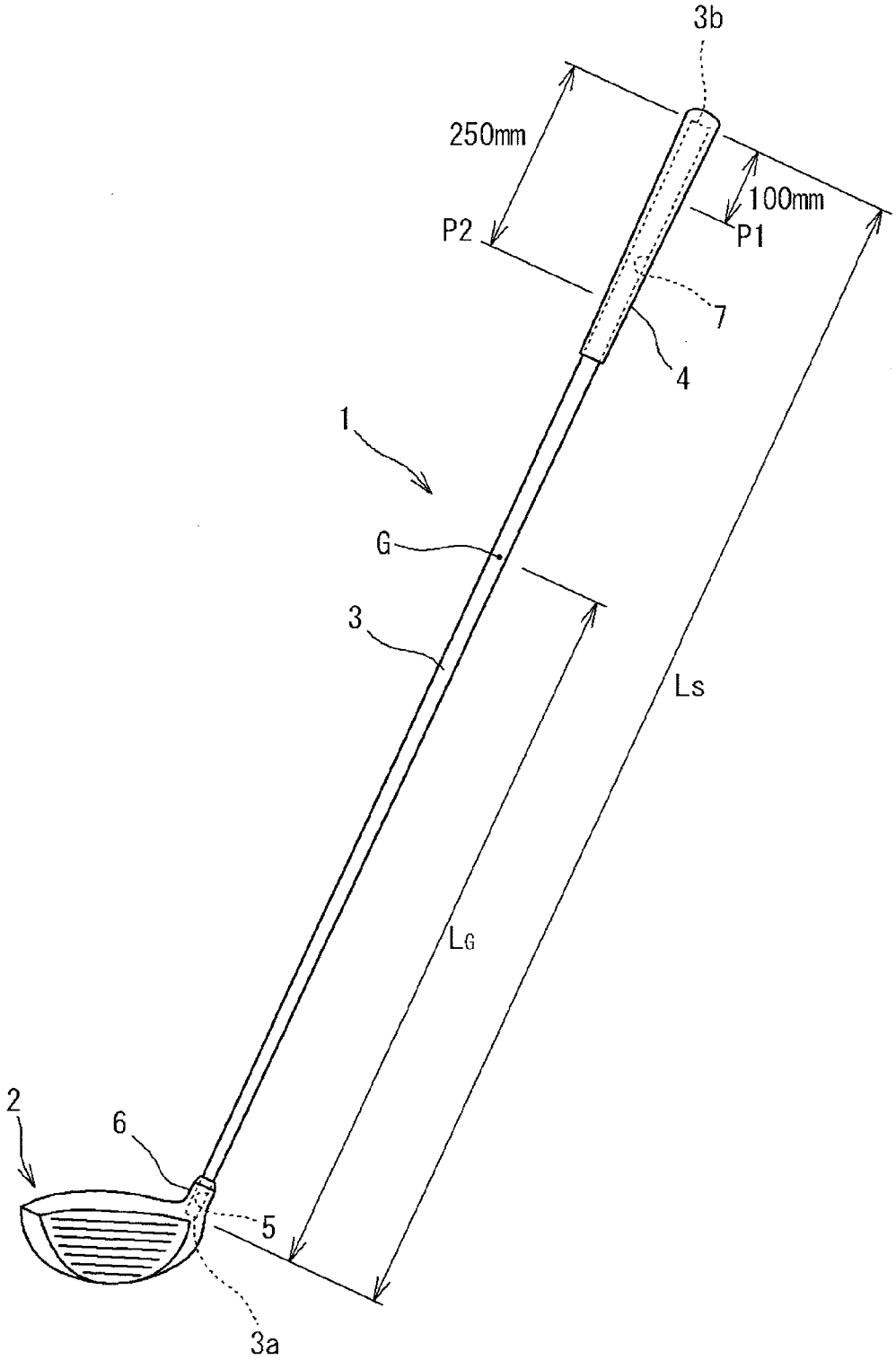
FIG. 1 is an illustrative diagram of a golf club including one embodiment of a golf club shaft of the present invention.

FIG. 1 is an illustrative diagram showing the entirety of a golf club 1 including a golf club shaft (hereinafter, may be referred to as "shaft") according to one embodiment of the present invention. The golf club 1 includes a wood-type golf club head 2 having a predetermined loft angle, a shaft 3, and a grip 4. The head 2 includes a hosel 6 having a shaft hole 5 to which a tip end 3*a* located at the front end side of the shaft 3 is inserted and fixed. A butt end 3*b* at the back end side of the shaft 3 is inserted and fixed in a grip hole 7 of the grip 4. The tip end 3*a* is located inside the head 2, and the butt end 3*b* is located inside the grip 4. It should be noted that, in FIG. 1, a reference character of "G" indicates the center of gravity (center of gravity point) of the shaft 3. The center of gravity G is located on a shaft axis inside the shaft 3.

The weight of the golf club 1 is not particularly limited in the present invention, and is preferably configured within a range not exceeding 300 g. If the weight of the golf club 1 is too light, the strengths of respective elements (parts) forming the golf club 1 become low, and durability of the golf club 1 may deteriorate. Therefore, the weight of the golf club 1 is preferably not smaller than 270 g, and further preferably not smaller than 273 g. On the other hand, if the weight of the golf club 1 is too heavy, it becomes difficult to perform a swing, so that it becomes difficult to increase the head speed. Therefore, the weight of the golf club 1 is further preferably not larger than 295 g, and particularly preferably not larger than 290 g.

Further, the length of the golf club 1 itself is also not particularly limited in the present invention, and is ordinarily from 44.0 to 47.0 inches. If the length of the golf club 1 is too short, although a swing can be performed easily, a turning radius of the swing becomes small, so that it becomes difficult to obtain a sufficient head speed. As a result, the ball speed cannot be increased, and the flight distance of the ball cannot be extended. Therefore, the length of the golf club 1 is preferably not smaller than 44.5 inches, and further preferably not smaller than 45.0 inches. On the other hand, if the length of the golf club 1 is too long, the head speed decreases since it becomes difficult to swing the club. Therefore, the ball speed cannot be increased, and the flight distance of the ball cannot be extended. Thus, the length of the golf club 1 is preferably not larger than 46.5 inches, and further preferably not larger than 46.0 inches.

It should be noted that, in the present specification, "club length" is a length measured based on the description in "Appendix II—Design of Clubs" "1. Clubs" "1c. Length" in the Rules of Golf determined by R&A (The Royal and Ancient Golf Club of Saint Andrews).

[Head Configuration]

The head 2 in the present embodiment is a hollow head and has a large inertia moment. For a club having the head 2 with a large inertia moment, the head 2 is preferably hollow since the advantageous effect of improving flight distance can be stably obtained.

There is no particular limitation in the material of the head 2 in the present invention, and, for example, titanium, titanium alloys, CFRPs (carbon fiber reinforced plastics), stainless steel, maraging steel, soft iron, and the like can be used. Furthermore, instead of manufacturing the head 2 using a single material, the head 2 may be manufactured by combining multiple materials as appropriate. For example, a CFRP and a titanium alloy can be combined together. From a standpoint of lowering the center of gravity of the head 2, it is possible to employ a head in which at least a portion of a crown is made from a CFRP, and at least a portion of a sole is made from a titanium alloy. In addition, from a standpoint of strength, the entirety of a face is preferably made from a titanium alloy.

In the present invention, although the weight of the head 2 itself is not particularly limited, it is preferably within a range from 185 to 210 g. If the head 2 is too light, the kinetic energy of the head 2 cannot be sufficiently provided to the ball, and it becomes difficult to increase the ball speed. Therefore, the weight of the head 2 is further preferably not smaller than 188 g, and particularly preferably not smaller than 192 g. On the other hand, if the weight of the head 2 is too heavy, the golf club 1 becomes heavy and difficult to swing. Therefore, the weight of the head 2 is further preferably not larger than 206 g, and particularly preferably not larger than 203 g.

Furthermore, in the golf club 1 of the present embodiment, the ratio (head weight/club weight) of the head weight to the club weight is set to be not lower than 0.67 but not higher than 0.72. If this ratio is too small, the kinetic energy of the head 2 becomes small and obtaining a sufficient ball speed becomes difficult. Therefore, the ratio is preferably not lower than 0.675, and further preferably not lower than 0.68. On the other hand, if the ratio is too large, the head 2 becomes too heavy and swinging the club becomes difficult. Therefore, the ratio is preferably not higher than 0.718, and further preferably not higher than 0.715.

[Grip Configuration]

In the present invention, there is no particular limitation in the material and structure of the grip 4, and those commonly used can be adopted as appropriate. For example, there can be used one that is obtained by blending and kneading natural rubber, oil, carbon black, sulfur, and zinc oxide, and molding and vulcanizing the materials into a predetermined shape.

In the present invention, although the weight of the grip 4 itself is not particularly limited, it is ordinarily set to be not smaller than 27 g but not larger than 45 g. If the weight of the grip 4 is too small, the strength of the grip 4 becomes low, and its durability may deteriorate. Therefore, the weight of the grip 4 is preferably not smaller than 30 g, and further preferably not smaller than 33 g. On the other hand, if the weight of the grip 4 is too large, the golf club 1 becomes heavy and difficult to swing. Therefore, the weight of the grip 4 is preferably not larger than 41 g, and further preferably not larger than 38 g.

[Shaft Configuration]

The shaft 3 in the present embodiment is a carbon shaft, and is manufactured through an ordinary sheet winding process using a prepreg sheet as a material. In more detail, the shaft 3 is a tubular body formed from a laminated body of a fiber reinforced resin layer, and has a hollow structure. The full length of the shaft 3 is represented as $L_S$, and the distance from the tip end (front end) 3*a* of the shaft 3 to the center of gravity G of the shaft 3 is represented as $L_G$.

The weight of the shaft 3 in the present invention is set to be not larger than 55 g. If the weight of the shaft 3 is too light, the possibility becomes high for strengths such as flexural strength to be insufficient due to having a small thickness. Therefore, ordinarily, the weight of the shaft 3 is set to be not smaller than 30 g, preferably not smaller than 32 g, and further preferably not smaller than 34 g. On the other hand, if the weight of the shaft 3 is larger than 55 g, it becomes difficult to perform a swing at an increased speed due to the whole golf club 1 being heavy. Therefore, the weight of the shaft 3 is preferably not larger than 54 g, and further preferably not larger than 53 g.

Further, although the length of the shaft 3 itself is not particularly limited in the present invention, it is ordinarily from 105 to 120 cm. If the length of the shaft 3 is too short, a turning radius of the swing becomes small, and it becomes difficult to obtain a sufficient head speed. As a result, the ball speed cannot be increased, and the flight distance of the ball cannot be extended. Therefore, the length of the shaft 3 is preferably not smaller than 107 cm, and further preferably not smaller than 110 cm. On the other hand, if the length of the shaft 3 is too long, the inertia moment at the grip end becomes large, and a powerless golfer can become easily overwhelmed in terms of power. Therefore, the head speed cannot be increased, and the flight distance of the ball cannot be extended. Thus, the length of the shaft 3 is preferably not larger than 118 cm, and further preferably not larger than 116 cm.

Furthermore, although the position of the center-of-gravity itself of the shaft 3 is not particularly limited in the present invention, it is ordinarily located within a range of, for example, for a shaft whose length is 46 inches, 600 to 750 mm from the tip end 3*a* (front end) of the shaft 3. If the center of gravity G of the shaft 3 is located closer than 600 mm from the front end of the shaft 3, there is a high possibility of not being able to increase head speed since the ease of swinging the club has not been improved due to the position of the center of gravity not being sufficiently moved in the hand side direction. Therefore, the position of the center of gravity of the shaft 3 from the front end of the shaft 3 is preferably not closer than 615 mm, and further preferably not closer than 630 mm. On the other hand, if the position of the center of gravity G of the shaft 3 is farther than 750 mm from the front end of the shaft 3, there is a high possibility of strengths such as flexural strength being insufficient due to a small thickness on the front end side of the shaft. Therefore, the position of the center of gravity of the shaft 3 from the front end of the shaft 3 is preferably not farther than 730 mm, and further preferably not farther than 710 mm.

In the present invention, when the distance from the front end of the shaft 3 to the center of gravity G of the shaft is represented as $L_G$ and when the full length of the shaft 3 is represented as $L_S$, $0.54 \leq L_G/L_S \leq 0.65$ is satisfied.

If $L_G/L_S$ is lower than 0.54, since the center of gravity of the shaft is located close the front end side of the shaft, the weight of the head has to be reduced in order to obtain a swing balance equivalent to that obtained from a hitherto known club, and the degree of freedom in designing a head becomes small. Thus, the inertia moment of the head becomes small, and a technique for lowering the center of gravity cannot be implemented. Therefore, it becomes difficult to achieve a large ball flight distance. Hence, $L_G/L_S$ is preferably not lower than 0.55 and further preferably not lower than 0.56.

On the other hand, if $L_G/L_S$ is higher than 0.65, the weight on the hand side of the shaft becomes large and the weight on the front end side of the shaft becomes small when the weight of the shaft is unchanged. As a result, the strength on the front end side of the shaft may become weak. Furthermore, to increase the ratio higher than 0.65 while preventing deterioration of the strength on the front end side of the shaft means to increase the weight on the hand side while maintaining the weight on the front end side of the shaft; and this causes the full weight of the club to be too large and swinging the club becomes difficult. Therefore, $L_G/L_S$ is preferably not higher than 0.64, and further preferably not higher than 0.63.

Furthermore, in the present invention, the torque value of the shaft is set to be not higher than 6.5. If the torque value is larger than 6.5, variability of a hit ball becomes large since the head can easily be overwhelmed by a ball when an off-center shot missing the sweet spot is hit. Therefore, the torque value is preferably not higher than 6.3 and further preferably not higher than 6.1.

On the other hand, the torque value is preferably not lower than 3.0. When the torque value is lower than 3.0, a user will perceive swinging to be difficult since the shaft is felt to be stiff due to twisting of the shaft being small. Therefore, the torque value is preferably not lower than 3.5 and further preferably not lower than 4.0.

A preferable example of a method for maintaining a predetermined strength while keeping the torque value small is, a method of using a combination of a prepreg comprising a pitch-based fiber and a prepreg comprising a PAN-based fiber at, for example, the front end portion of the shaft, and more specifically within a range of 300 mm from the tip end of the shaft. A PAN-based fiber has high strength but is inferior in resistance to impact when compared to a pitch-based fiber. Therefore, by combining a PAN-based fiber and a pitch-based fiber, the front end portion of the shaft can have certain strength and resistance to impact even when its thickness is small. It should be noted that, in the present specification, "front end part" or "front end portion" of a shaft refers to a portion up to 300 mm from the tip end of the shaft, "back end part" or "back end portion" of a shaft refers to a portion up to 300 mm from the butt end of the shaft, and "center part" or "center portion" of the shaft refers to the rest of the portion, that is the portion in the shaft other than the "front end part" and the "back end part."

Under a condition that a combination of a PAN-based fiber and a pitch-based fiber is to be used, various mass proportions can be selected for prepregs used in the front end portion of the shaft, and, preferably, 15 to 25 mass % thereof is a pitch-based fiber and 75 to 85 mass % thereof is a PAN-based fiber. In a case where the proportion of the pitch-based fiber is lower than 15 mass %, since the pitch-based fiber has superior impact absorption power, a reduction in the proportion thereof results in deterioration of impact strength. Therefore, the proportion of the pitch-based fiber is preferably not lower than 16 mass %, and further preferably not lower than 17 mass %. On the other hand, in a case where the proportion of the pitch-based fiber is higher than 25 mass %, since the pitch-based fiber has low flexural strength in the fiber direction when compared to the PAN-based fiber, flexural strength deteriorates. Therefore, the proportion of the pitch-based fiber is preferably not higher than 24 mass %, and further preferably not higher than 23 mass %.

Furthermore, in a case where the proportion of the PAN-based fiber is lower than 75 mass %, since the PAN-based fiber has a higher flexural strength in the fiber direction when compared the pitch-based fiber, a reduction in the proportion thereof results in a deterioration of flexural strength of the shaft. Therefore, the proportion of the PAN-based fiber is preferably not lower than 76 mass %, and further preferably not lower than 77 mass %. On the other hand, in a case where the proportion of the PAN-based fiber is higher than 85 mass %, impact strength deteriorates. Therefore, the proportion of the PAN-based fiber is preferably not higher than 84 mass %, and further preferably not higher than 83 mass %.

Furthermore, with regard to the prepreg of the PAN-based fiber, preferably, not less than 50 mass % thereof is a 0° layer and not less than 15 mass % thereof is a 45° layer. The 45° layer has a characteristic of being able to easily adjust torque when compared to the other layers of 0° layer and 90° layer. In a case where the 0° layer of the prepreg of the PAN-based fiber is less than 50 mass %, since the 0° layer has large flexural strength in the fiber direction when compared to the other layers with an angle, reduction in the proportion of the 0° layer results in deterioration of flexural strength. Therefore, the 0° layer of the prepreg of the PAN-based fiber is preferably not less than 51 mass %, and further preferably not less than 52 mass %. On the other hand, in a case where the 0° layer of the prepreg of the PAN-based fiber is more than 80 mass %, since flexural rigidity becomes higher as the proportion of the 0° layer becomes larger, flexural rigidity of the shaft becomes too high. Therefore, the 0° layer of the prepreg of the PAN-based fiber is preferably not more than 79 mass %, and further preferably not more than 78 mass %.

Furthermore, in a case where the 45° layer of the prepreg of the PAN-based fiber is less than 15 mass %, since twist rigidity and twist strength become lower as the proportion of the 45° layer becomes smaller, the torque value becomes large. Therefore, the 45° layer of the prepreg of the PAN-based fiber is preferably not less than 18 mass %, and further preferably not less than 21 mass %. On the other hand, in a case where the 45° layer of the prepreg of the PAN-based fiber is more than 30 mass %, the torque value becomes too small and the feel when hitting a ball deteriorates. Therefore, the 45° layer of the prepreg of the PAN-based fiber is preferably not more than 27 mass %, and further preferably not more than 24 mass %.

Furthermore, lowering torque of the whole shaft can be achieved by, other than the method of partially lowering torque at the front end part of the shaft, lowering torque of other portions. With this, variability of a hit ball can be reduced. Specifically, lowering torque of the whole shaft can be achieved by, for example, setting the proportion of 45° layer (bias layer) included in the front end part, center part, and back end part of the shaft as front end part<center part≤back end part, and setting the proportion of the 45° layer in the center part and back end part to be larger than its proportion in the front end part. In this case, the proportions of the 45° layer in the front end part, center part, and back end part may be set as, for example, 20 to 35 mass %, 30 to 45 mass %, and 30 to 45 mass %, respectively. More specifically, the proportions of the 45° layer included in the front end part, center part, and back end part of the shaft may be set as, for example, 25 mass %, 35 mass %, and 40 mass %, respectively.

With regard to the back end part of the shaft, when the center of gravity is set on the butt side, although flex can be adjusted, EI can easily become large due to a large thickness. Therefore, it may be easily perceived as stiff on the hand side, and the feel deteriorates. Thus, by increasing the proportion of bias layer while softening the flex of the back end part, it is possible to reduce torque of the whole and improve directionality of a hit ball.

The shaft 3 can be manufactured by curing a prepreg sheet, and fibers in this prepreg sheet are orientated substantially in one direction. A prepreg whose fibers are orientated substantially in one direction is also referred to as a UD (Uni-Direction) prepreg. It should be noted that, in the present invention, prepregs other than a UD prepreg can also be used, and, for example, a prepreg sheet in which fibers included in the sheet are knitted can also be used.

The prepreg sheet includes a matrix resin formed from a thermosetting resin and the like, and a fiber such as a carbon fiber. As described above, although the shaft 3 can be manufactured through a sheet winding process, the matrix resin is in a semi-cured state in a prepreg form. The shaft 3 is obtained by winding and curing the prepreg. The curing of the prepreg is conducted by applying heat, and steps for manufacturing the shaft 3 include a heating step. The matrix resin in the prepreg sheet is cured in this heating step.

The matrix resin of the prepreg sheet is also not particularly limited in the present invention, and, for example, thermoplastic resins and thermosetting resins such as epoxy resins can be used. From a standpoint of enhancing the strength of the shaft, an epoxy resin is preferably used.

As the prepreg, a commercially available product can be used as appropriate, and the following Table 1-1 and Table 1-2 show examples of prepregs that can be used as the shaft of the golf club of the present invention.

TABLE 1-1

Example of Usable Prepreg

| Manufacturer Name | Prepreg Sheet Stock Number | Sheet Thickness (mm) | Fiber Content (Mass %) | Resin Content (Mass %) |
|---|---|---|---|---|
| Toray Industries, Inc. | 3255S-10 | 0.082 | 76 | 24 |
| Toray Industries, Inc. | 3255S-12 | 0.103 | 76 | 24 |
| Toray Industries, Inc. | 3255S-15 | 0.123 | 76 | 24 |
| Toray Industries, Inc. | 805S-3 | 0.034 | 60 | 40 |
| Toray Industries, Inc. | 2255S-10 | 0.082 | 76 | 24 |
| Toray Industries, Inc. | 2255S-12 | 0.102 | 76 | 24 |
| Toray Industries, Inc. | 2255S-15 | 0.123 | 76 | 24 |
| Toray Industries, Inc. | 2256S-10 | 0.077 | 80 | 20 |
| Toray Industries, Inc. | 2256S-12 | 0.103 | 80 | 20 |
| Toray Industries, Inc. | 9255S-8 | 0.061 | 76 | 24 |
| Nippon Graphite Fiber Corp. | E1026A-09N | 0.100 | 63 | 37 |
| Nippon Graphite Fiber Corp. | E1026A-14N | 0.150 | 63 | 37 |
| Mitsubishi Rayon Co., Ltd. | TR350C-100S | 0.083 | 75 | 25 |
| Mitsubishi Rayon Co., Ltd. | TR350C-125S | 0.104 | 75 | 25 |
| Mitsubishi Rayon Co., Ltd. | TR350C-150S | 0.124 | 75 | 25 |
| Mitsubishi Rayon Co., Ltd. | TR350C-175S | 0.146 | 75 | 25 |
| Mitsubishi Rayon Co., Ltd. | MR350C-075S | 0.063 | 75 | 25 |
| Mitsubishi Rayon Co., Ltd. | MR350C-100S | 0.085 | 75 | 25 |
| Mitsubishi Rayon Co., Ltd. | MR350C-125S | 0.105 | 75 | 25 |
| Mitsubishi Rayon Co., Ltd. | MR350E-100S | 0.093 | 70 | 30 |
| Mitsubishi Rayon Co., Ltd. | HRX350C-075S | 0.057 | 75 | 25 |
| Mitsubishi Rayon Co., Ltd. | HRX350C-110S | 0.082 | 75 | 25 |

TABLE 1-2

| Example of Usable Prepreg | | | | |
|---|---|---|---|---|
| | | Carbon Fiber Physical Property Value | | |
| Manufacturer Name | Prepreg Sheet Stock Number | Carbon Fiber Stock Number | Tensile Elastic Modulus* ($t/mm^2$) | Tensile Strength* ($kgf/mm^2$) |
| Toray Industries, Inc. | 3255S-10 | T700S | 23.5 | 500 |
| Toray Industries, Inc. | 3255S-12 | T700S | 23.5 | 500 |
| Toray Industries, Inc. | 3255S-15 | T700S | 23.5 | 500 |
| Toray Industries, Inc. | 805S-3 | M30S | 30 | 560 |
| Toray industries, Inc. | 2255S-10 | T800S | 30 | 600 |
| Toray Industries, Inc. | 2255S-12 | T800S | 30 | 600 |
| Toray Industries, Inc. | 2255S-15 | T800S | 30 | 600 |
| Toray Industries, Inc. | 2256S-10 | T800S | 30 | 600 |
| Toray Industries, Inc. | 2256S-12 | T800S | 30 | 600 |
| Toray Industries, Inc. | 9255S-8 | M40S | 40 | 470 |
| Nippon Graphite Fiber Corp. | E1026A-09N | XN-10 | 10 | 190 |
| Nippon Graphite Fiber Corp. | E1026A-14N | XN-10 | 10 | 190 |
| Mitsubishi Rayon Co., Ltd. | TR350C-100S | TR50S | 24 | 500 |
| Mitsubishi Rayon Co., Ltd. | TR350C-125S | TR50S | 24 | 500 |
| Mitsubishi Rayon Co., Ltd. | TR350C-150S | TR50S | 24 | 500 |
| Mitsubishi Rayon Co., Ltd. | TR350C-175S | TR50S | 24 | 500 |
| Mitsubishi Rayon Co., Ltd. | MR350C-075S | MR40 | 30 | 450 |
| Mitsubishi Rayon Co., Ltd. | MR350C-100S | MR40 | 30 | 450 |
| Mitsubishi Rayon Co., Ltd. | MR350C-125S | MR40 | 30 | 450 |
| Mitsubishi Rayon Co., Ltd. | MR350E-100S | MR40 | 30 | 450 |
| Mitsubishi Rayon Co., Ltd. | HRX350C-075S | HR40 | 40 | 450 |
| Mitsubishi Rayon Co., Ltd. | HRX350C-110S | HR40 | 40 | 450 |

*Tensile strength and tensile elastic modulus are values measured in accordance with "Carbon fiber testing method" of JIS R7601: 1986.

Figure 2:
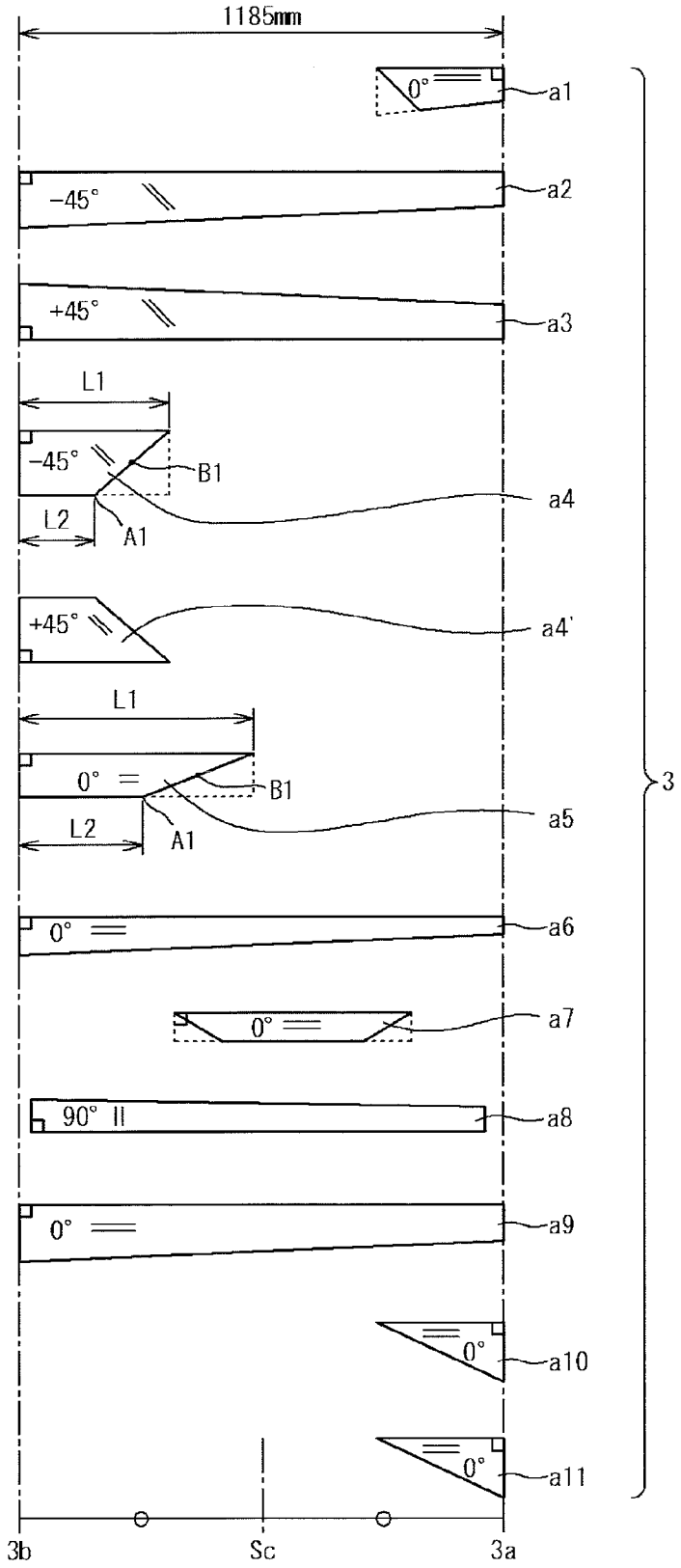
FIG. 2 is an expansion plan of prepreg sheets forming the shaft in the golf club shown in FIG. 1.

FIG. 2 is an expansion plan (sheet block diagram) of the prepreg sheets forming the shaft 3. The shaft 3 includes multiple sheets, and in the embodiment shown in FIG. 2, the shaft 3 includes twelve sheets of a1 to a11. The expansion plan shown in FIG. 2 shows the sheets forming the shaft, sequentially from the inner side of a radial direction of the shaft. In the expansion plan, winding is conducted sequentially from a sheet located on the upper side. Further, in the expansion plan shown in FIG. 2, the right-left direction in the drawing coincides with the axial direction of the shaft, the right side in the drawing is the tip end 3*a* side of the shaft 3, and the left side in the drawing is the butt end 3*b* side of the shaft 3.

It should be noted that, in the present specification, a term "layer" and a term "sheet" are used. The "sheet" is a designation for those prior to being wound, and the "layer" is a designation for the sheets after being wound. The "layer" is formed by winding the "sheet." Furthermore, in the present specification, the same reference character is used for a layer and a sheet. For example, a layer formed by winding the sheet a1 is described as a layer a1.

Furthermore, in the present specification, regarding the angle of a fiber with respect to the axial direction of the shaft, an angle Af and an absolute angle θa are used. The angle Af is an angle that is associated with a plus or a minus, and the absolute angle θa is an absolute value of the angle Af. The absolute angle θa is an absolute value of an angle between the axial direction of the shaft and a fiber direction. For example, "the absolute angle θa being equal to or smaller than 10°" means "the angle Af being not smaller than −10° but not larger than +10°".

The expansion plan shown in FIG. 2 not only shows a winding sequence of each of the sheets, but also shows a position of each of the sheets in the axial direction of the shaft. For example, the end of the sheet a1 is located at the tip end 3*a*, and the ends of the sheets a4, a4' and the sheet a5 are located at the butt end 3*b*.

The shaft 3 includes straight layers, bias layers, and a hoop layer. The expansion plan shown in FIG. 2 describes an orientation angle of a fiber included in the prepreg sheet; and a sheet having a description of "0°" forms a straight layer. A sheet for the straight layer is also referred to as a straight sheet in the present specification. In addition, a sheet for the bias layer is also referred to as a bias sheet in the present specification.

The straight layer is a layer whose fiber orientation is substantially 0° with respect to a longitudinal direction of the shaft (axial direction of the shaft). However, there are cases where the direction of the fiber is not perfectly 0° with respect to the axial direction of the shaft, due to errors at the time of winding. Ordinarily, in the straight layer, the absolute angle θa is equal to or smaller than 10°.

In the embodiment shown in FIG. 2, the straight sheets are the sheet a1, the sheet a5, the sheet a6, the sheet a7, the sheet a9, the sheet a10, and the sheet a11. The straight layer is highly correlated with flexural rigidity and flexural strength of the shaft.

The bias layer is a layer whose fiber orientation is slanted with respect to the longitudinal direction of the shaft. The bias layer is highly correlated with twist rigidity and twist strength of the shaft. The bias layer is preferably formed from a pair of two sheets whose fiber orientations are slanted in directions opposite to each other. From a standpoint of twist rigidity, the absolute angle θa of the bias layer is preferably equal to or larger than 15°, more preferably equal to or larger than 25°, and further preferably equal to or larger than 40°. On the other hand, from the standpoint of twist rigidity and twist strength, the absolute angle θa of the bias layer is preferably equal to or smaller than 60°, and more preferably equal to or smaller than 50°.

In the embodiment shown in FIG. 2, the bias sheets are the sheet a2, the sheet a3, the sheet a4, and the sheet a4'. In FIG. 2, the angle Af is described for all of the sheets. Plus (+) and minus (−) of the angles Af indicate that fibers of the bias sheets are slanted in directions opposite to each other. It should be noted that, in the embodiment shown in FIG. 2, although the angle Af of the sheet a2 is −45° and the angle Af of the sheet a3 is +45°, contrary to that, the angle Af of the sheet a2 may be +45° and the angle Af of the sheet a3 may be −45°.

In the embodiment shown in FIG. 2, the sheet forming the hoop layer is the sheet a8. The absolute angle θa of the hoop layer is preferably substantially 90° with respect to the axial direction of the shaft. However, there are cases where the direction of the fiber is not perfectly 90° with respect to the axial direction of the shaft, due to errors at the time of winding. Ordinarily, in the hoop layer, the absolute angle θa is not smaller than 80° but not larger than 90°.

The hoop layer contributes to enhancing crush rigidity and crush strength of the shaft. The crush rigidity is rigidity against crushing force toward the inner side of the radial direction of the shaft. The crush strength is strength against crushing force toward the inner side of the radial direction of the shaft. The crush strength may also relate to flexural strength. Furthermore, crush deformation may occur associated with flexural deformation. This association is particularly large for a thin lightweight shaft. By improving the crush strength, flexural strength can be improved.

Although not diagrammatically represented, the prepreg sheet before it is being used is sandwiched between cover sheets. Ordinarily, a cover sheet consists of a release paper and a resin film, and the release paper is pasted on one surface of the prepreg sheet, and the resin film is pasted on the other surface. In the following description, the surface on which the release paper is pasted is also referred to as "release paper side surface" and the surface on which the resin film is pasted is also referred to as "film side surface."

The expansion plans in the present specification are diagrams in which the film side surface is on the front side. In other words, in the expansion plans in the present specification, the front side in the drawing is the film side surface, and the reverse side in the drawing is the release paper side surface. In the expansion plan shown in FIG. 2, the fiber direction of the sheet a2 and the fiber direction of the sheet a3 are identical, whereas when being attached as described later, the sheet a3 will be turned over. As a result, the fiber direction of the sheet a2 and the fiber direction of the sheet a3 become directions opposite to each other, and thereby, in a state after the winding, the fiber direction of the sheet a2 and the fiber direction of the sheet a3 will be directions opposite to each other. This point is taken into consideration, and in FIG. 2, the fiber direction of the sheet a2 is denoted as "−45°" and the fiber direction of the sheet a3 is denoted as "+45°."

In order to wind the above described prepreg sheet, firstly, the resin film is peeled. By peeling the resin film, the film side surface becomes exposed. This exposed surface has tackiness (adhesiveness) originating from the matrix resin. Since the matrix resin of the prepreg at the time of the winding is in a semi-cured state, the matrix resin expresses adhesiveness. Next, a margin part (wind-start margin part) on the exposed surface of the film side is attached to a to-be-wound object. Attaching to the wind-start margin part can be smoothly conducted due to the adhesiveness of the matrix resin. The to-be-wound object is a mandrel, or a wound object obtained by winding another prepreg sheet on a mandrel.

Next, the release paper of the prepreg sheet is peeled. Then, the to-be-wound object is rotated to wind the prepreg sheet on the to-be-wound object. In the manner described above, first, the resin film is peeled; next, the wind-start margin part is attached to the to-be-wound object, and then, the release paper is peeled. With such a procedure, occurrences of wrinkling of the prepreg sheet and inferior winding can be prevented. The release paper has high flexural rigidity when compared to the resin film, and a sheet having such release paper attached thereto is supported by the release paper and is unlikely to wrinkle.

Figure 3A:
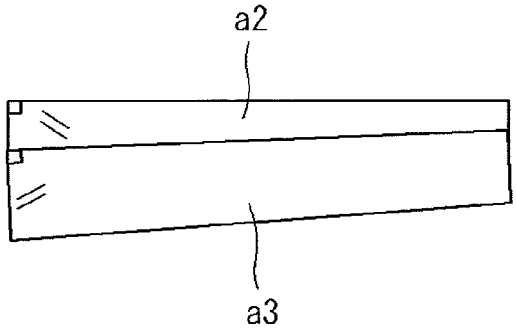
FIG. 3A is a plan view of a first merged sheet in the shaft shown in FIG. 2.
Figure 3B:
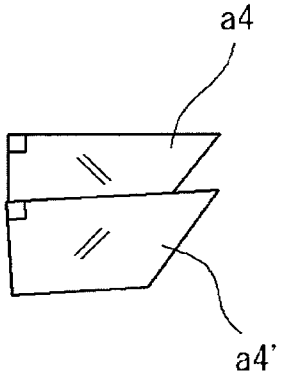
FIG. 3B is a plan view of a second merged sheet in the shaft shown in FIG. 2.
Figure 4:
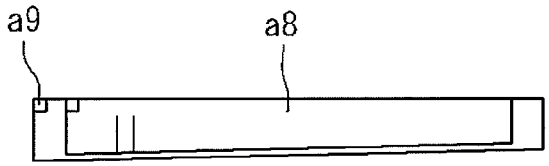
FIG. 4 is a plan view of a third merged sheet in the shaft shown in FIG. 2.

In the embodiment shown in FIG. 2, a merged sheet formed by attaching two or more sheets together is employed. For the embodiment shown in FIG. 2, three merged sheets shown in FIGS. 3 and 4 are employed. FIG. 3A shows a first merged sheet a23 formed by attaching the sheet a2 and the sheet a3 together, and FIG. 3B shows a second merged sheet a44' formed by attaching the sheet a4 and the sheet a4' together. In addition, FIG. 4 shows a third merged sheet a89 formed by attaching the sheet a8 and the sheet a9 together.

The procedure for manufacturing the first merged sheet a23 will be described below. First, the bias sheet a3 is turned over, and the turned over bias sheet a3 is attached to the bias sheet a2. At that time, as shown in (a) of FIG. 3A, a butt end and a tip end of the bias sheet a3 are each attached to the bias sheet a2 so as to be misaligned from a long side of the bias sheet a2.

As a result, the sheet a2 and the sheet a3 of the merged sheet a23 are misaligned from each other by about half a wind in the shaft after the winding.

The second merged sheet a44' is manufactured in a manner similar to the first merged sheet a23, and the sheet a4 and the sheet a4' of the merged sheet a44' are misaligned from each other by about half a wind in the shaft after the winding.

As shown in FIG. 4, in the third merged sheet a89, the upper end of the sheet a8 matches the upper end of the sheet a9. Additionally, in the sheet a89, the entirety of the sheet a8 is pasted on the sheet a9 in a state where a butt side end margin of the sheet a8 is misaligned from a butt side end margin of the sheet a9. As a result, inferior winding of the sheet a8 in the winding step is prevented.

As described above, in the present specification, although the sheets and layers are classified by their fiber's orientation angle in the prepreg, the sheets and layers can be further classified by their length in the axial direction of the shaft.

In the present specification, a layer arranged over the whole axial direction of the shaft is referred to as a full length layer, and a sheet arranged over the whole axial direction of the shaft is referred to as a full length sheet. On the other hand, in the present specification, a layer partially arranged in the axial direction of the shaft is referred to as a partial layer, and a sheet partially arranged in the axial direction of the shaft is referred to as a partial sheet.

In the present specification, a straight layer that is a full length layer is referred to as a full length straight layer. In the embodiment shown in FIG. 2, the sheet a6 and the sheet a9 form the full length straight layers after the winding.

In addition, in the present specification, a straight layer that is a partial layer is referred to as a partial straight layer. In the embodiment shown in FIG. 2, the sheet a1, the sheet a5, the sheet a7, the sheet a10, and the sheet a11 form the partial straight layers after the winding.

After the winding, the sheet a7, which is a sheet included in the partial layers, forms a middle partial layer located in the middle of the whole axial direction of the shaft. Thus, a front end of the middle partial layer is separated from the tip end 3*a*, and a back end of the middle partial layer is separated from the butt end 3*b*. Preferably, the middle partial layer is arranged at a position including a center position Sc of the axial direction of the shaft. Furthermore, preferably, the middle partial layer is arranged at a position including a B point (a point located 525 mm away from the tip end) defined by a method for measuring three point flexural strength (a measuring method for SG-type three point flexural strength testing). The middle partial layer can selectively reinforce a portion that has large deformation, and can also contribute to weight reduction of the shaft.

In the present specification, a term "butt partial layer" is used. The butt partial layer is one mode of the partial layer, and is a partial layer that is located on the butt end 3*b* side. Shown in FIG. 2 with a reference character of "A1" is a point located on the most butt side on a side of the butt partial layer in the tip side. Preferably, a point A1 is located closer to the butt side than the center position Sc of the axial direction of the shaft. Shown in FIG. 2 with a reference character of "B1" is a middle point of a side of the butt partial layer in the tip side. Preferably, a point B1 is located closer to the butt side than the center position Sc of the axial direction of the shaft. The butt partial layer includes a butt straight layer, a butt hoop layer, and a butt bias layer.

In addition, in the present specification, a term "butt straight layer" is used. The butt straight layer is one mode of the partial straight layer, and is a partial straight layer located on the butt end 3*b* side. Preferably, the entirety of the butt straight layer is located closer to the butt side than the center position Sc of the axial direction of the shaft. The back end of the butt straight layer may or may not be located at the butt end 3*b* of the shaft. From a standpoint of bringing the position of the center of gravity of the club close to the butt end 3*b*, preferably, an arrangement range of the butt straight layer includes a position P1 that is separated from the butt end 3*b* of the shaft by 100 mm. From a standpoint of bringing the position of the center of gravity of the club close to the butt end 3*b*, more preferably, the back end of the butt straight layer is located at the butt end 3*b* of the shaft. In the embodiment shown in FIG. 2, the butt straight layer is the sheet a5.

The shaft 3 is manufactured through a sheet winding process using the prepreg sheet shown in FIG. 2. In the following, a general outline of the steps for manufacturing the shaft 3 will be described.

[General Outline of Shaft Manufacturing Steps]

(1) Cutting Step

In a cutting step, the prepreg sheet is cut into predetermined shapes, and each of the sheets shown in FIG. 2 is cut out.

(2) Attaching Step

In an attaching step, multiple sheets are attached together to manufacture the merged sheet a23, the merged sheet a44', and the merged sheet a89 described above. For the attaching, applying of heat or pressing can be used; however, from a standpoint of reducing misalignments between sheets forming a merged sheet in a later described winding step and improving accuracy of the winding, the applying of heat and the pressing are preferably used in combination. Although heating temperature and pressing pressure can be selected as appropriate from a standpoint of enhancing the adhesive strength among the sheets, the heating temperature is ordinarily within a range from 30 to 60° C., and the pressing pressure is ordinarily within a range from 300 to 600 g/cm$^2$. Similarly, although heating time and pressing time can also be selected as appropriate from a standpoint of enhancing the adhesive strength among the sheets, the heating time is ordinarily within a range from 20 to 300 seconds, and the pressing time is ordinarily within a range from 20 to 300 seconds.

(3) Winding Step

In the winding step, a mandrel is used. A representative mandrel is made from metal, and a mold releasing agent is applied on a circumferential surface of the mandrel. Additionally, a resin (tacking resin) having adhesiveness is applied over the mold releasing agent. The cut sheets are wound on the mandrel which has the resin applied thereon. As a result of the tacking resin, an end part of the sheet can be attached easily to the mandrel. A sheet obtained by attaching multiple sheets together is wound in a state of a merged sheet.

With this winding step, a wound body can be obtained. The wound body is obtained by winding a prepreg sheet on the outer side of the mandrel. The winding is conducted, for example, by rolling a to-be-wound object on a flat surface.

(4) Tape Wrapping Step

In a tape wrapping step, a tape referred to as a wrapping tape is wound on an outer circumferential surface of the wound body. The wrapping tape is wound on the outer circumferential surface of the wound body while being kept in tension. With the wrapping tape, pressure is applied to the wound body and void in the wound body is reduced.

(5) Curing Step

In a curing step, the wound body which has been wrapped with the tape is heated at a predetermined temperature. As a result of the heating, the matrix resin in the prepreg sheet is cured. In the curing process, the matrix resin temporarily fluidizes, and through this fluidization, air within or between the sheets is discharged. The discharging of air is enhanced by the pressure (fastening force) provided by the wrapping tape. With the curing step, a cured lamination body is obtained.

(6) Mandrel Draw-Out Step and Wrapping Tape Removal Step

After the curing step, a mandrel draw-out step and a wrapping tape removal step are conducted. Although there is no particular limitation in the sequence of the two steps in the present invention, from a standpoint of improving efficiency of the wrapping tape removal, the wrapping tape removal step is preferably conducted after the mandrel draw-out step.

(7) Both-Ends Cutting Step

In a both-ends cutting step, both ends of the cured lamination body obtained through each of the steps of (1) to (6) described above are cut. As a result of the cutting, the end surface of the tip end 3*a* and the end surface of the butt end 3*b* of the shaft become smooth.

(8) Polishing Step

In a polishing step, the surface of the cured lamination body whose both ends are cut is polished. Helical concavities and convexities remain on the surface of the cured lamination body as traces of the wrapping tape used in step (4) described above. As a result of the polishing, the helical concavities and convexities which are traces of the wrapping tape disappear, and the surface of the cured lamination body becomes smooth.

(9) Painting Step

A prescribed paint is applied on the cured lamination body after the polishing step.

With the above described steps, the shaft 3 can be manufactured. The golf club 1 can be obtained by fixing the tip end 3*a* of the manufactured shaft 3 in the shaft hole 5 of the hosel 6 of the golf club head 2, and fixing the butt end 3*b* of the shaft 3 in the grip hole 7 of the grip 4.

One feature of the present invention is that, in the golf club 1 described above, when the distance from the front end 3*a* of the shaft 3 to the center of gravity of the shaft is represented as $L_G$ and when the full length of the shaft is represented as $L_S$, $0.54 \leq L_G/L_S \leq 0.65$ is satisfied and the center of gravity G of the shaft 3 is brought close to the hand side.

Reducing club weight is effective in making the club easy to swing. However, the weight of the head which is one element forming the club is a factor that influences an increase in ball speed. Therefore, in the present invention, an approach of increasing the ball speed without reducing the head weight is adopted. By placing the position of the center of gravity of the shaft on the grip side, the inertia moment of the club is reduced to make the club easy to swing.

Means for adjusting the position of the center of gravity of the shaft 3 include, for example, the following (A) to (H). In the present invention, it is possible to bring the position of the center of gravity of the shaft 3 close to the hand side by employing one or more of these means as appropriate.

(A) Increasing or decreasing the number of windings of the butt partial layer
(B) Increasing or decreasing the thickness of the butt partial layer
(C) Increasing or decreasing a length L1 (described later) of the butt partial layer
(D) Increasing or decreasing a length L2 (described later) of the butt partial layer
(E) Increasing or decreasing the number of windings of the tip partial layer
(F) Increasing or decreasing the thickness of the tip partial layer
(G) Increasing or decreasing a shaft direction length of the tip partial layer
(H) Increasing or decreasing a taper rate of the shaft <Weight Ratio of Butt Partial Layer>

From a standpoint of placing the position of the center of gravity of the shaft on the grip side, the weight of the butt partial layer with respect to the shaft weight is preferably not smaller than 5 wt %, and more preferably not smaller than 10 wt %. On the other hand, from a standpoint of reducing a stiff feel, the weight of the butt partial layer with respect to the shaft weight is preferably not larger than 50 wt %, and more preferably not larger than 45 wt %. In the embodiment shown in FIG. 2, a total weight of the sheet a4 and the sheet a5 is the weight of the butt partial layer.

<Weight Ratio of Butt Partial Layer in Specific Butt Range>

Indicated as "P2" in FIG. 1 is a point separated from the butt end 3*b* by 250 mm. A range from point P2 to the butt end 3*b* is defined as a "specific butt range." When the weight of the butt partial layer existing in the specific butt range is represented as "Wa," and when the weight of the shaft in the specific butt range is represented as "Wb," from a standpoint of placing the position of the center of gravity of the shaft on the grip side, the ratio (Wa/Wb) is preferably not lower than 0.4, more preferably not lower than 0.42, and further preferably not lower than 0.44. On the other hand, from a standpoint of reducing a stiff feel, the ratio (Wa/Wb) is preferably not higher than 0.7, more preferably not higher than 0.65, and further preferably not higher than 0.6.

<Fiber Elastic Modulus of Butt Partial Layer>

From a standpoint of ensuring strength of the butt partial layer, the fiber elastic modulus of the butt partial layer is preferably not lower than 5 t/mm$^2$, and more preferably not lower than 7 t/mm$^2$. When the center of gravity of the club is close to the butt end 3*b*, centrifugal force that acts upon the center of gravity of the club easily decreases. In other words, when the center-of-gravity position of the shaft is placed on the grip side, the centrifugal force that acts upon the center of gravity of the club easily decreases. In such a case, it becomes difficult to sense the bending of the shaft, and a stiff feel is easily generated. From a standpoint of reducing such a stiff feel, the fiber elastic modulus of the butt partial layer is preferably not higher than 20 t/mm$^2$, more preferably not higher than 15 t/mm$^2$, and further preferably not higher than 10 t/mm$^2$.

<Resin Content of Butt Partial Layer>

From a standpoint of placing the center-of-gravity position of the shaft on the grip side and reducing a stiff feel, the resin content of the butt partial layer is preferably not lower than 20 mass %, and more preferably not lower than 25 mass %. On the other hand, from a standpoint of ensuring strength of the butt partial layer, the resin content of the butt partial layer is preferably not higher than 50 mass %, and more preferably not higher than 45 mass %.

<Weight of Butt Straight Layer>

From a standpoint of placing the position of the center of gravity of the shaft on the grip side, the weight of the butt straight layer is preferably not smaller than 2 g, and more preferably not smaller than 4 g. On the other hand, from a standpoint of reducing a stiff feel, the weight of the butt straight layer is preferably not larger than 30 g, more preferably not larger than 20 g, and further preferably not larger than 10 g.

<Weight Ratio of Butt Straight Layer>

From a standpoint of placing the position of the center of gravity of the shaft on the grip side, the weight of the butt straight layer with respect to the shaft weight Ws is preferably not smaller than 5 mass %, and more preferably not smaller than 10 mass %. On the other hand, from a standpoint of reducing a stiff feel, the weight of the butt straight layer with respect to the shaft weight is preferably not larger than 50 mass %, and more preferably not larger than 45 mass %. In the embodiment shown in FIG. 3, the total weight of the sheet a4 and the sheet a5 is the weight of the butt straight layer.

<Fiber Elastic Modulus of Butt Straight Layer>

From a standpoint of ensuring strength of the butt part, the fiber elastic modulus of the butt straight layer is preferably not lower than 5 t/mm$^2$, and more preferably not lower than 7 t/mm$^2$. On the other hand, from a standpoint of reducing a stiff feel, the fiber elastic modulus of the butt straight layer is preferably not higher than 20 t/mm$^2$, more preferably not higher than 15 t/mm$^2$, and further preferably not higher than 10 t/mm$^2$.

<Resin Content of Butt Straight Layer>

From a standpoint of placing the position of the center of gravity of the shaft on the grip side, and reducing a stiff feel, the resin content of the butt partial layer is preferably not lower than 20 mass %, and more preferably not lower than 25 mass %. On the other hand, from a standpoint of ensuring strength of the butt part, the resin content of the butt straight layer is preferably not higher than 50 mass %, and more preferably not higher than 45 mass %.

<Maximum Shaft Direction Length L1 of Butt Partial Layer>

Shown as "L1" in FIG. 2 is the maximum shaft direction length of the butt partial layer. The maximum length L1 is determined in each butt partial sheet. In the embodiment shown in FIG. 2, a length L1 of the sheet a4 is different from a length L1 of the sheet a5.

From a standpoint of ensuring weight of the butt partial layer, the length L1 is preferably not smaller than 100 mm, more preferably not smaller than 125 mm, and further preferably not smaller than 150 mm. On the other hand, from a standpoint of placing the position of the center of gravity of the shaft on the grip side, the length L1 is preferably not larger than 700 mm, more preferably not larger than 650 mm, and further preferably not larger than 600 mm.

<Minimum Shaft Direction Length L2 of Butt Partial Layer>

Shown as "L2" in FIG. 2 is the minimum shaft direction length of the butt partial layer. The minimum length L2 is determined in each butt partial sheet. In the embodiment shown in FIG. 2, a length L2 of the sheet a4 is different from a length L2 of the sheet a5.

From a standpoint of ensuring weight of the butt partial layer, the length L2 is preferably not smaller than 50 mm, more preferably not smaller than 75 mm, and further preferably not smaller than 100 mm. On the other hand, from a standpoint of placing the position of the center of gravity of the shaft on the grip side, the length L2 is preferably not larger than 650 mm, more preferably not larger than 600 mm, and further preferably not larger than 550 mm.

EXAMPLES

Next, the golf club according to the present invention will be described based on Examples; however, the present invention is not limited only to those Examples.

Golf clubs according to Examples 1 to 19 and Comparative Examples 1 to 6 were manufactured in accordance with a hitherto known method, and their performances and characteristics were evaluated. A substantially identical shaped head was used for all the golf clubs, and the volume of the head was 460 cc, and the material of the head was a titanium alloy. Head weights, grip weights, shaft weights, shaft lengths etc., were adjusted so as to obtain desired specifications.

Shafts for the Examples and Comparative Examples were manufactured based on the expansion plan shown in FIG. 2. The used manufacturing method was similar to that used for the shaft 3 described above, and the shafts were manufactured in accordance with the steps of (1) to (9). For each of the sheets a1 to a11, the number of windings, the thickness of the prepreg, the fiber content of the prepreg, and the tensile elastic modulus of carbon fiber etc., were selected as appropriate. Examples of the prepregs used for the shafts in the Examples and Comparative Examples are shown in Table 2. For adjusting the position of the center of gravity of the shafts, one or more of the above described (A) to (H) were used.

TABLE 2

| Specification of Prepreg Sheet | | | | | | | | |
|---|---|---|---|---|---|---|---|---|
| | | | | | | Carbon Fiber Physical Property Value | | |
| Reference Character of Cut Sheet | Manufacturer Name | Prepreg Sheet Stock Number | Sheet Thickness (mm) | Fiber Content (Mass %) | Resin Content (Mass %) | Carbon Fiber Stock Number | Tensile Elastic Modulus (t/mm$^2$) | Tensile Strength (kgf/mm$^2$) |
| a1 | Nippon Graphite Fiber Corp. | E1026A-14N | 0.15 | 63 | 37 | XN-10 | 10 | 190 |
| a2, a3 | Toray Industries, Inc. | 9255S-8 | 0.061 | 76 | 24 | M40S | 40 | 470 |
| a4, a4' | Mitsubishi Rayon Co., Ltd. | MR350C-125S | 0.104 | 75 | 25 | TR50S | 24 | 500 |
| a5 | Nippon Graphite Fiber Corp. | E1026A-09M | 0.1 | 63 | 37 | XN-10 | 10 | 190 |
| a6, a7, a10, a11 | Mitsubishi Rayon Co., Ltd. | TR350C-100S | 0.083 | 75 | 25 | TR50S | 24 | 500 |
| a8 | Toray Industries, Inc. | 805S-3 | 0.0342 | 60 | 40 | M30S | 30 | 560 |
| a9 | Mitsubishi Rayon Co., Ltd. | TR350C-175S | 0.146 | 75 | 25 | TR50S | 24 | 500 |

Specifications and evaluations of the golf clubs according to Examples 1 to 6 and Comparative Examples 1 to 3 are shown in Table 3-1 and Table 3-2. In addition, specifications and evaluations of golf clubs according to Examples 1, 7 to 13 and Comparative Example 4 are shown in Table 4-1 and Table 4-2. Further, specifications and evaluations of golf clubs according to Examples 1, 14 to 19 and Comparative Examples 5 to 6 are shown in Table 5-1, Table 5-2, and Table 5-3.

TABLE 3-1

| Specifications and Evaluation Results of Examples and Comparative Examples | | | | | |
|---|---|---|---|---|---|
| | Comp. Ex. 1 | Ex. 2 | Ex. 1 | Ex. 3 | Comp. Ex. 2 |
| $L_G$/Ls (Proportion of center of gravity) | 0.5 | 0.55 | 0.6 | 0.65 | 0.7 |
| Ls (inch) | 45.5 | 45.5 | 45.5 | 45.5 | 45.5 |
| Shaft Weight (g) | 50 | 50 | 50 | 50 | 50 |
| Torque (°) | 4.5 | 4.5 | 4.5 | 4.5 | 4.5 |
| Proportion of fiber in range of 300 mm from tip end of shaft | | | | | |
| Pitch-based fiber (%) | 20 | 20 | 20 | 20 | 20 |
| PAN-based fiber Total (%) | 80 | 80 | 80 | 80 | 80 |
| 0° layer of PAN-based fiber (%) | 55 | 55 | 55 | 55 | 55 |
| 45° layer of PAN-based fiber (%) | 23 | 23 | 23 | 23 | 23 |
| Proportion of 45° layer in front end part (%) | 23 | 23 | 23 | 23 | 23 |
| Proportion of 45° layer in center part (%) | 38 | 38 | 38 | 38 | 38 |
| Proportion of 45° layer in back end part (%) | 38 | 38 | 38 | 38 | 38 |
| Evaluation of feel | 1 | 3 | 4 | 4 | 5 |
| Flexural strength of front end part (T-point) (kgf) | 240 | 230 | 220 | 190 | 160 |

TABLE 3-1-continued

| Specifications and Evaluation Results of Examples and Comparative Examples | | | | | |
|---|---|---|---|---|---|
| | Comp. Ex. 1 | Ex. 2 | Ex. 1 | Ex. 3 | Comp. Ex. 2 |
| Impact energy of front end part (J) | 4.2 | 4 | 3.8 | 3.7 | 3.6 |
| Twist strength (kg · cm) | 1500 | 1500 | 1500 | 1500 | 1400 |
| Remarks | Under lower limit of $L_G$/Ls | Near lower limit of $L_G$/Ls | Medium value for each parameter | Near upper limit of $L_G$/Ls | Over upper limit of $L_G$/Ls |

TABLE 3-2

| Specifications and Evaluation Results of Examples and Comparative Examples | | | | | |
|---|---|---|---|---|---|
| | Ex. 4 | Ex. 5 | Ex. 1 | Ex. 6 | Comp. Ex. 3 |
| $L_G$/Ls (Proportion of center of gravity) | 0.6 | 0.6 | 0.6 | 0.6 | 0.6 |
| Ls (inch) | 45.5 | 45.5 | 45.5 | 45.5 | 45.5 |
| Shaft Weight (g) | 29 | 40 | 50 | 55 | 60 |
| Torque (°) | 4.5 | 4.5 | 4.5 | 4.4 | 4.4 |
| Proportion of fiber in range of 300 mm from tip end of shaft | | | | | |
| Pitch-based fiber (%) | 20 | 20 | 20 | 20 | 20 |
| PAN-based fiber Total (%) | 80 | 80 | 80 | 80 | 80 |
| 0° layer of PAN-based fiber (%) | 55 | 55 | 55 | 55 | 55 |
| 45° layer of PAN-based fiber (%) | 23 | 23 | 23 | 23 | 23 |
| Proportion of 45° layer in front end part (%) | 23 | 23 | 23 | 23 | 23 |
| Proportion of 45° layer in center part (%) | 38 | 38 | 38 | 38 | 38 |
| Proportion of 45° layer in back end part (%) | 38 | 38 | 38 | 38 | 38 |
| Evaluation of feel | 5 | 4 | 4 | 3 | 2 |
| Flexural strength of front end part (T-point) (kgf) | 170 | 190 | 220 | 230 | 240 |
| Impact energy of front end part (J) | 3.4 | 3.6 | 3.8 | 3.9 | 3.95 |
| Twist strength (kg · cm) | 1300 | 1500 | 1500 | 1500 | 1500 |
| Remarks | Under lower limit of shaft weight | Near lower limit of shaft weight | Medium value for each parameter | Near upper limit of shaft weight | Over upper limit of shaft weight |

TABLE 4-1

| Specifications and Evaluation Results of Examples and Comparative Examples | | | | | |
|---|---|---|---|---|---|
| | Ex. 7 | Ex. 8 | Ex. 1 | Ex. 9 | Comp. Ex. 4 |
| $L_G$/Ls (Proportion of center of gravity) | 0.6 | 0.6 | 0.6 | 0.55 | 0.55 |
| Ls (inch) | 45.5 | 45.5 | 45.5 | 45.5 | 45.5 |
| Shaft Weight (g) | 50 | 50 | 50 | 50 | 50 |
| Torque (°) | 2.5 | 3.5 | 4.5 | 6 | 7 |
| Proportion of fiber in range of 300 mm from tip end of shaft | | | | | |
| Pitch-based fiber (%) | 20 | 20 | 20 | 20 | 20 |
| PAN-based fiber Total (%) | 80 | 80 | 80 | 80 | 80 |
| 0° layer of PAN-based fiber (%) | 51 | 53 | 55 | 57 | 59 |
| 45° layer of PAN-based fiber (%) | 27 | 25 | 23 | 21 | 19 |
| Proportion of 45° layer in front end part (%) | 23 | 23 | 23 | 23 | 23 |
| Proportion of 45° layer in center part (%) | 38 | 38 | 38 | 38 | 38 |
| Proportion of 45° layer in back end part (%) | 38 | 38 | 38 | 38 | 38 |
| Evaluation of feel | 2 | 4 | 4 | 3 | 2 |
| Flexural strength of front end part (T-point) (kgf) | 180 | 200 | 220 | 230 | 240 |
| Impact energy of front end part (J) | 3.8 | 3.8 | 3.8 | 3.8 | 3.8 |
| Twist strength (kg · cm) | 1600 | 1500 | 1500 | 1400 | 1200 |
| Remarks | Under lower limit of torque | Near lower limit of torque | Medium value for each parameter | Near upper limit of torque | Over upper limit of torque |

TABLE 4-2

| Specifications and Evaluation Results of Examples | Ex. 10 | Ex. 11 | Ex. 12 | Ex. 13 |
|---|---|---|---|---|
| $L_G$/Ls (Proportion of center of gravity) | 0.6 | 0.6 | 0.6 | 0.6 |
| Ls (inch) | 45.5 | 45.5 | 45.5 | 45.5 |
| Shaft Weight (g) | 50 | 50 | 50 | 50 |
| Torque (°) | 4.5 | 4.5 | 4.5 | 4.5 |
| Proportion of fiber in range of 300 mm from tip end of shaft | | | | |
| Pitch-based fiber (%) | 10 | 15 | 25 | 30 |
| PAN-based fiber Total (%) | 90 | 85 | 75 | 70 |
| 0° layer of PAN-based fiber (%) | 60 | 58 | 52 | 50 |
| 45° layer of PAN-based fiber (%) | 23 | 23 | 23 | 23 |
| Proportion of 45° layer in front end part (%) | 23 | 23 | 23 | 23 |
| Proportion of 45° layer in center part (%) | 38 | 38 | 38 | 38 |
| Proportion of 45° layer in back end part (%) | 38 | 38 | 38 | 38 |
| Evaluation of feel | 2 | 2 | 4 | 4 |
| Flexural strength of front end part (T-point) (kgf) | 240 | 230 | 200 | 180 |
| Impact energy of front end part (J) | 3.4 | 3.6 | 4 | 4.2 |
| Twist strength (kg · cm) | 1500 | 1500 | 1500 | 1500 |
| Remarks | Under lower limit of fiber proportion of pitch-based fiber | Near lower limit of fiber proportion of pitch-based fiber | Near upper limit of fiber proportion of pitch-based fiber | Over upper limit of fiber proportion of pitch-based fiber |

TABLE 5-1

| Specifications and Evaluation Results of Examples and Comparative Examples | Comp. Ex. 5 | Ex. 14 | Ex. 1 | Ex. 15 | Ex. 16 |
|---|---|---|---|---|---|
| $L_G$/Ls (Proportion of center of gravity) | 0.6 | 0.6 | 0.6 | 0.6 | 0.6 |
| Ls (inch) | 45.5 | 45.5 | 45.5 | 45.5 | 45.5 |
| Shaft Weight (g) | 50 | 50 | 50 | 50 | 50 |
| Torque (°) | 7 | 6 | 4.5 | 3.5 | 2.5 |
| Proportion of fiber in range of 300 mm from tip end of shaft | | | | | |
| Pitch-based fiber (%) | 20 | 20 | 20 | 20 | 20 |
| PAN-based fiber Total (%) | 80 | 80 | 80 | 80 | 80 |
| 0°- layer of PAN-based fiber (%) | 65 | 60 | 55 | 50 | 45 |
| 45° layer of PAN-based fiber (%) | 13 | 18 | 23 | 28 | 33 |
| Proportion of 45° layer in front end part (%) | 13 | 18 | 23 | 28 | 33 |
| Proportion of 45° layer in center part (%) | 28 | 33 | 38 | 43 | 48 |
| Proportion of 45° layer in back end part (%) | 28 | 33 | 38 | 43 | 48 |
| Evaluation of feel | 1 | 2 | 4 | 4 | 4 |
| Flexural strength of front end part (T-point) (kgf) | 240 | 230 | 220 | 200 | 180 |
| Impact energy of front end part (J) | 3.8 | 3.8 | 3.8 | 3.8 | 3.8 |
| Twist strength (kg · cm) | 1300 | 1400 | 1500 | 1600 | 1700 |
| Remarks | Under lower limit of proportion of 45° layer of PAN-based fiber | Near lower limit of proportion of 45° layer of PAN-based fiber | Medium value for each parameter | Near upper limit of proportion of 45° layer of PAN-based fiber | Over upper limit of proportion of 45° layer of PAN-based fiber |

TABLE 5-2

| Specifications and Evaluation Results of Examples and Comparative Examples | Comp. Ex. 6 | Ex. 17 | Ex. 1 |
|---|---|---|---|
| $L_G$/Ls (Proportion of center of gravity) | 0.6 | 0.6 | 0.6 |
| Ls (inch) | 45.5 | 45.5 | 45.5 |
| Shaft Weight (g) | 50 | 50 | 50 |
| Torque (°) | 7 | 6 | 4.5 |
| Proportion of fiber in range of 300 mm from tip end of shaft | | | |
| Pitch-based fiber (%) | 20 | 20 | 20 |
| PAN-based fiber Total (%) | 80 | 80 | 80 |
| 0° layer of PAN-based fiber (%) | 65 | 60 | 55 |

TABLE 5-2-continued

| Specifications and Evaluation Results of Examples and Comparative Examples | | | |
|---|---|---|---|
| | Comp. Ex. 6 | Ex. 17 | Ex. 1 |
| 45° layer of PAN-based fiber (%) | 13 | 18 | 23 |
| Proportion of 45° layer in front end part (%) | 13 | 18 | 23 |
| Proportion of 45° layer in center part (%) | 11 | 35 | 38 |
| Proportion of 45° layer in back end part (%) | 9 | 38 | 38 |
| Evaluation of feel | 2 | 3 | 4 |
| Flexural strength of front end part (T-point) (kgf) | 240 | 230 | 220 |
| Impact energy of front end part (J) | 3.8 | 3.8 | 3.8 |
| Twist strength (kg · cm) | 1300 | 1400 | 1500 |
| Remarks | Under lower limit of proportion of 45° layer in front end part Front end part > Center part < Back end part | Near lower limit of proportion of 45° layer in front end part Front end part < Center part < Back end part | Medium value for each parameter |

TABLE 5-3

| Specifications and Evaluation Results of Examples | | |
|---|---|---|
| | Ex. 18 | Ex. 19 |
| $L_G$/Ls (Proportion of center of gravity) | 0.6 | 0.6 |
| Ls (inch) | 45.5 | 45.5 |
| Shaft Weight (g) | 50 | 50 |
| Torque (°) | 3.5 | 2.5 |
| Proportion of fiber in range of 300 mm from tip end of shaft | | |
| Pitch-based fiber (%) | 20 | 20 |
| PAN-based fiber Total (%) | 80 | 80 |
| 0° layer of PAN-based fiber (%) | 50 | 45 |
| 45° layer of PAN-based fiber (%) | 28 | 33 |
| Proportion of 45° layer in front end part (%) | 28 | 33 |
| Proportion of 45° layer in center part (%) | 40 | 30 |
| Proportion of 45° layer in back end part (%) | 45 | 27 |
| Evaluation of feel | 5 | 2 |
| Flexural strength of front end part (T-point) (kgf) | 200 | 180 |
| Impact energy of front end part (J) | 3.8 | 3.8 |
| Twist strength (kg · cm) | 1600 | 1700 |
| Remarks | Near upper limit of proportion of 45° layer in front end part Front end part < Center part < Back end part | Over upper limit of proportion of 45° layer in front end part Front end part < Center part > Back end part |

[Evaluation Method]

<Shaft Torque>

Figure 5:
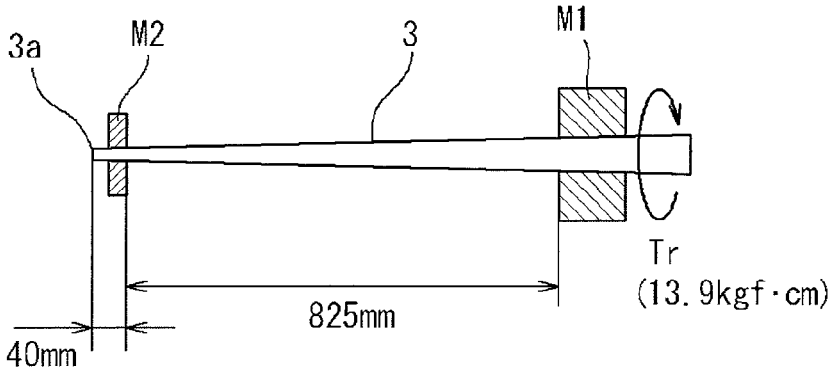
FIG. 5 is for describing a method for measuring torque of a shaft.

FIG. 5 is an illustrative diagram of a method for measuring a torque value (°) of a shaft. In this method, the front end part of the shaft 3 was fixed by a jig M2 so as to be unable to rotate, the back end part of the shaft was held by a jig M1, and a torque Tr of 13.9 kgf·cm was applied at a position 865 mm from the front end 3*a* of the shaft. A twist angle (°) of the shaft at this location where the torque was applied was used as a torque value of the shaft. A rotation speed of the jig M1 when loading the torque Tr was set as to be not larger than 130°/minute, and a shaft direction length between the jig M1 and the jig M2 was set to 825 mm. Furthermore, if the shaft had deformed due to being held by the jig M1 or the jig M2, a core was placed inside the shaft for the measurement.

<Feel>

A golfer who has an average head speed of 42 m/s evaluated the feel when hitting five balls using the following five grades.

5 points: Good 4 points: Slightly good 3 points: Fair 2 points: Slightly poor 1 point: Poor <Shaft Front End Strength (T-Point Strength)>

Figure 6:
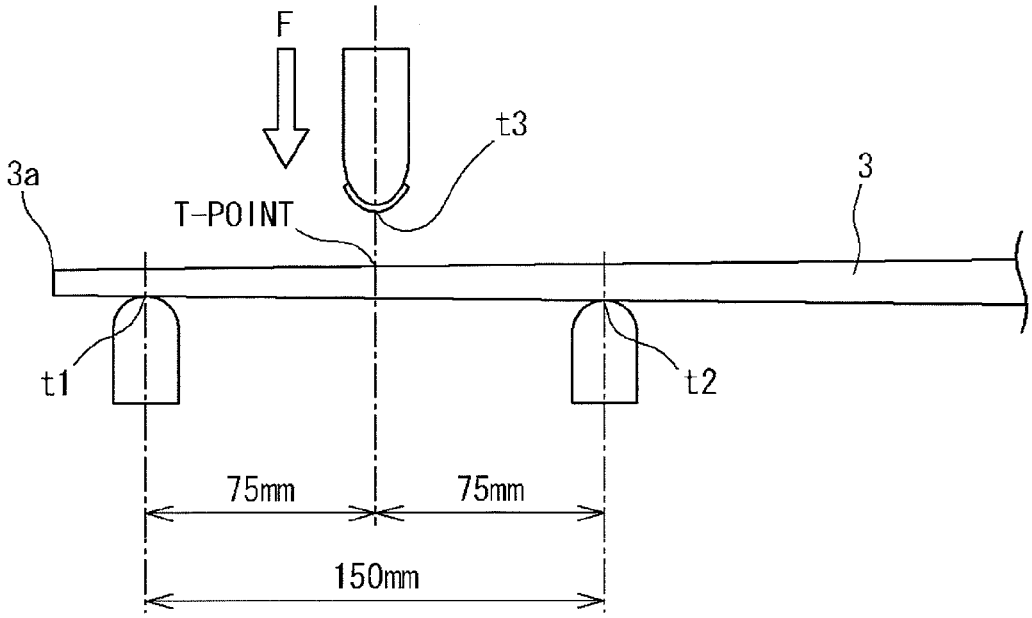
FIG. 6 is for describing a method for measuring T-point strength.

A shaft front end strength (T-point strength) was measured in accordance with a testing method defined by SG mark. SG-type three point flexural strength is a SG-type breaking strength determined by the Consumer Product Safety Association. FIG. 6 is an illustrative diagram for the method for measuring the SG-type three point flexural strength. As shown in FIG. 6, load F was applied downward from above at a load point t3 while the shaft 3 was supported from below at two support points t1 and t2. The position of the load point t3 was a position dividing the interval between the support point t1 and the support point t2. The load point t3 was matched with the point (T-point) that was to be measured, and measurement was conducted.

The T-point was a point 90 mm away from the head-side end part (tip end) 3*a*. When measuring was conducted at the T-point, measuring span in FIG. 6 was 150 mm. Therefore, the support point t1 was located at a point 15 mm away from the tip end 3*a*. A value of load F when the shaft 3 is damaged (peak value) is the SG-type three point flexural strength.

<Impact Energy of Front End Part>

Figure 7:
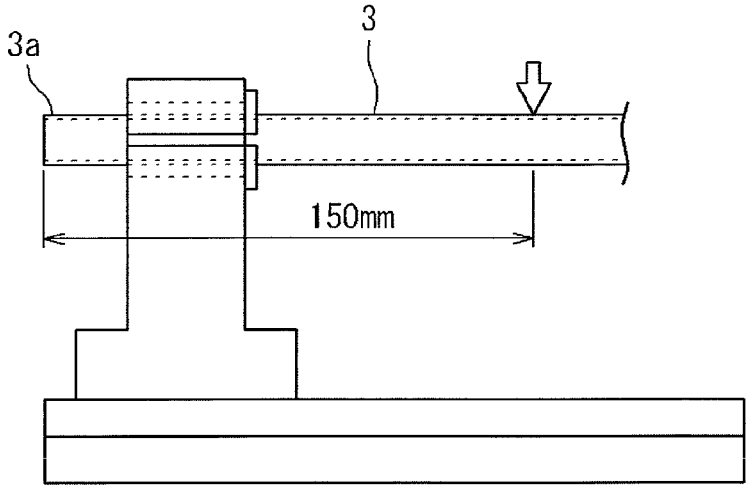
FIG. 7 is an outline illustrative diagram showing an impact testing method.

By using a drop impact testing machine (manufactured by Yonekura MFG Co., Ltd.) shown in FIG. 7, a 500 g weight was dropped from a height of 1.5 cm to a position 150 mm away from the tip end 3*a* of the shaft, and generated vibration waveform was read using a vibrometer (Charge Vibrometer Model-1607 manufactured by Showa Sokki Corp.). Per-load displacement function was obtained and energy value was calculated after correction was made to the vibration waveform using the level of velocity reduction from the initial velocity due to energy loss. The following formulae (1) to (3) are satisfied with regard to displacement, velocity, and energy, respectively.

$$\text{Displacement } \zeta = \int_0^t V(t)\,dt \tag{1}$$

$$\text{Velocity } V = \sqrt{V_0^2 - \frac{2E(t)}{M}} \tag{2}$$

$$\text{Energy } E(t) = \int_0^t I(t)V(t)\,dt \tag{3}$$

The above formulae (1) to (3) were solved using initial conditions E(0)=0, V(0)=0, and (0)=0, and discretized using quadratic equation.

$$\zeta(n+1) = \zeta \times n + \frac{Tn}{2}(V(n) + V(n+1)) \tag{4}$$

$$V(n+1) = \sqrt{V_n^2 - \frac{2}{M}(E(n+1) - E(n))} \tag{5}$$

$$E(n+1) = E(n) + \frac{T}{2}(I(n) \times V(n) + I(n+1) \times V(n+1)) \tag{6}$$

Then, formula (5) was expanded with $V(n)^2$, and assigned to formula (6) to obtain the following formula (7).

$$E(n+1) = E(n) + \frac{T}{2} \times \frac{(I(n) + I(n+1) \times V(n))}{1 + \frac{T}{2} \times I(n+1) \times \frac{1}{(V(n) \times M)}} \tag{7}$$

Figure 8:
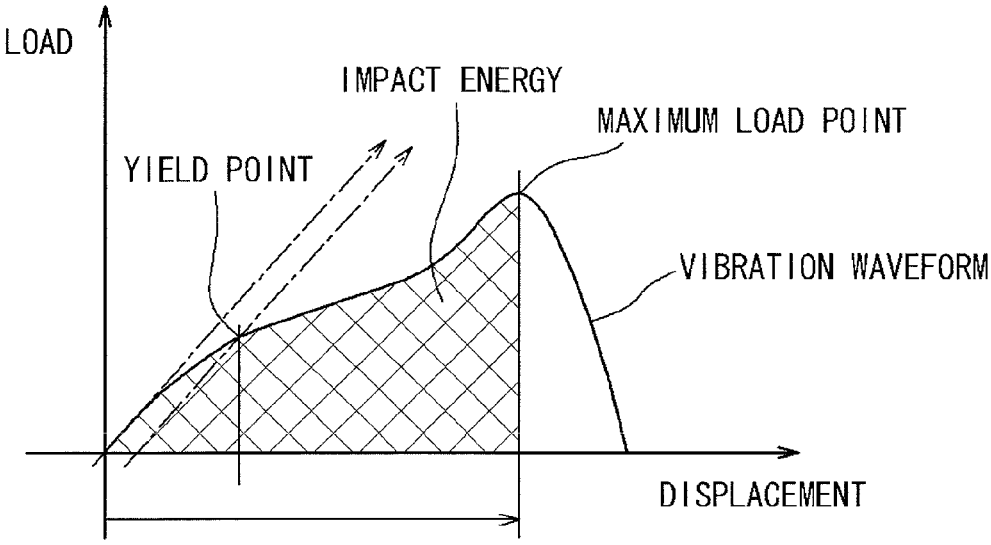
FIG. 8 is an illustrative diagram showing how to calculate impact energy.

Displacement and energy were successively calculated from formulae (4), (5), and (7). Vibration waveform obtained there is as shown in FIG. 8. In FIG. 8, impact energy was calculated as an area up to the maximum load point indicated by diagonal lines.

<Twist Strength>

A part that is 35 mm away from the tip end of the shaft was held and fixed by a drill chuck, a hole having a diameter of 5 mm was drilled at a position 1060 mm away from the tip end, a pin was inserted in that hole, and torque was applied using a torque motor. Value of torque was increased slowly, and force that had been applied when breakage (crack) occurred in the shaft was used as twist strength.

From the result shown in Tables 3 to 5, it can be understood that the golf clubs using the shafts according to the Examples can improve the feel when hitting a ball while ensuring strength (flexural strength and twist strength) of the shafts. On the other hand, for example, with a golf club according to Comparative Example 1, although strength of a shaft was ensured, evaluation of the feel when hitting a ball was low, since $L_G/L_S$ was lower than 0.54 which is the lower limit value. Furthermore, with a golf club according to Comparative Example 2, although evaluation of the feel when hitting a ball was high, flexural strength of the front end of the shaft was low, since $L_G/L_S$ was higher than 0.65 which is the upper limit value. In addition, golf clubs according to Comparative Examples 3 to 6 all had low evaluations for the feel, and golf clubs according to Comparative Examples 4 to 6 had low twist strength for the shafts.

[Other Modifications]

It should be understood that the embodiments disclosed herein are merely illustrative and not restrictive in all aspects. The scope of the present invention is defined by the scope of the claims rather than by the meaning described above, and is intended to include meaning equivalent to the scope of the claims and all modifications within the scope.

Figure 9:
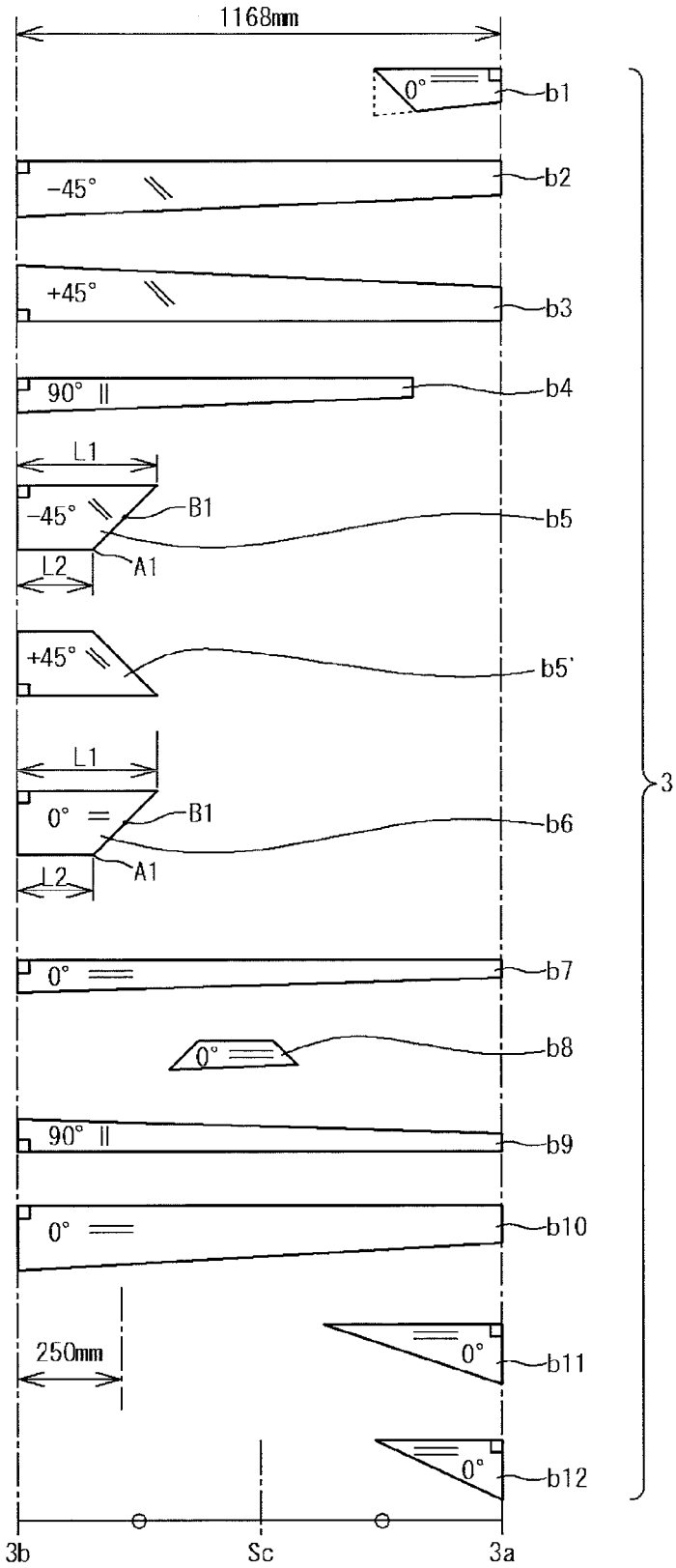
FIG. 9 is an expansion plan of prepreg sheets included in a modification of a golf club shaft of the present invention.

For example, in the above described embodiment, although a shaft having the expansion plan shown in FIG. 2 is adopted as the shaft of the golf club, the present invention is not limited thereto, and, for example, a shaft having an expansion plan shown in FIG. 9 may also be used. The shaft having the expansion plan shown in FIG. 9 includes thirteen sheets of b1 to b12. Similar to FIG. 2, the expansion plan shown in FIG. 9 shows the sheets forming the shaft, sequentially from the inner side of the radial direction of the shaft; and winding is conducted sequentially from a sheet located on the upper side in the expansion plan. Further, in the expansion plan shown in FIG. 9, the right-left direction in the drawing coincides with the axial direction of the shaft, the right side in the drawing is the tip end 3*a* side of the shaft 3, and the left side in the drawing is the butt end 3*b* side of the shaft 3.

In a modification shown in FIG. 9, the sheet b1, the sheet b6, the sheet b7, the sheet b8, the sheet b10, the sheet b11, and the sheet b12 are sheets forming the straight layers; the sheet b2, the sheet b3, the sheet b5, and the sheet b5' are sheets forming the bias layers; and the sheet b4 and the sheet b9 are sheets forming the hoop layers. As the sheets b1 to b12, for example, the following prepregs shown in Table 1 can be used.

Sheet b1: TR350C-125S
Sheets b2, b3: HRX350C-075S
Sheet b4: 805S-3
Sheets b5, b5': MR350C-125S
Sheet b6: E1026A-09N
Sheets b7, b8: TR350C-100S
Sheet b9: 805S-3
Sheet b10: MR350C-100S
Sheets b11, b12: TR350C-100S In the modification shown in FIG. 9, the major difference from that shown in FIG. 2 is arrangement of the sheet b4, which forms the partial hoop layer, between the sheets b2 and b3, which form the bias layers, and the sheets b5 and b5', which also form the bias layers.

Figure 10:
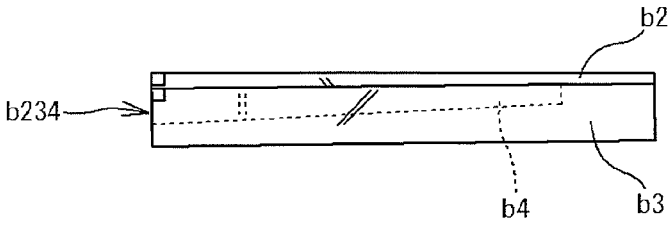
FIG. 10 is a plan view of a first merged sheet in the shaft shown in FIG. 9.
Figure 11:
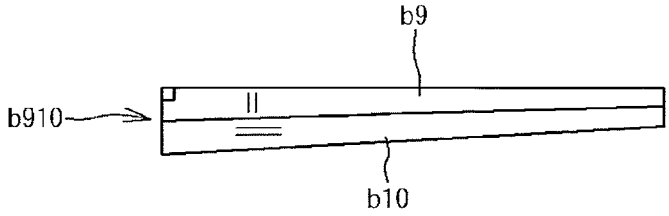
FIG. 11 is a plan view of a second merged sheet in the shaft shown in FIG. 9.

Also in the modification shown in FIG. 9, a merged sheet formed by attaching two or more sheets together is employed. In the modification shown in FIG. 9, two merged sheets shown in FIGS. 10 and 11 are employed. FIG. 10 shows a first merged sheet b234 formed by attaching the sheet b2, the sheet b3, and the sheet b4 together. In addition, FIG. 11 shows a second merged sheet b910 formed by attaching the sheet b9 and the sheet b10 together.

The procedure for manufacturing the first merged sheet b234 will be described below. A pre-merged sheet b34 is manufactured by attaching two sheets (bias sheet b3 and hoop sheet b4) together. When manufacturing the pre-merged sheet b34, the bias sheet b3 is turned over and attached to the hoop sheet b4. In the pre-merged sheet b34, the upper end of the sheet b4 matches the upper end of the sheet b3. Next, the pre-merged sheet b34 and the bias sheet b2 are attached together. The pre-merged sheet b34 and the bias sheet b2 are attached together in a state where they are misaligned from each other by half a wind.

In the merged sheet b234, the sheet b2 and the sheet b3 are misaligned from each other by half a wind. Thus, in the shaft after the winding, the circumferential direction position of the sheet b2 and the circumferential direction position of the sheet b3 are different. The angular difference here is preferably 180° (±15°).

As a result of using the merged sheet b234, the bias layer b2 and the bias layer b3 are misaligned from each other in the circumferential direction. With this misalignment, the positions of the ends of the bias layers are spread in the circumferential direction. As a result, it is possible to improve uniformity of the shaft in the circumferential direction. Further, in the merged sheet b234 in the present modification, the entirety of the hoop sheet b4 is sandwiched between the bias sheet b2 and the bias sheet b3. With this, it is possible to prevent inferior winding of the hoop sheet b4 in the winding step. By using the merged sheet b234, it is possible to improve accuracy of the winding. Here, inferior winding means disarray of fibers, generation of wrinkles, and deviation of fiber angle, etc.

Further, as shown in FIG. 11, in the second merged sheet b910, the upper end of the sheet b9 matches the upper end of the sheet b10. In addition, in the sheet b910, the entirety of the sheet b9 is pasted on the sheet b10. As a result, inferior winding of the sheet b9 is prevented in the winding step.

Also in the present modification, it is possible to adjust and bring the position of the center of gravity of the shaft close to the hand side by employing one or more of the previously described means of (A) to (H) as appropriate.

REFERENCE SIGNS LIST

1 wood-type golf club
2 head
3 shaft
3*a* tip end
3*b* butt end
4 grip
4*e* grip end
5 shaft hole
6 hosel
7 grip hole
G center of gravity of shaft
$L_G$ distance from the tip end of the shaft to the center of gravity of the shaft
$L_S$ shaft full length

What is claimed is:

1. A golf club shaft having a tip end, a central portion, and a butt end that is formed from multiple carbon fiber prepreg sheets wound to form layers each having straight or bias oriented fibers wherein, if a distance from the tip end of the shaft to a center of gravity of the shaft is $L_G$ and if the full length of the shaft is $L_S$, then the relationship $0.54 \leq L_G/L_S \leq 0.65$ is satisfied, the golf club shaft has a weight that is not larger than 55 g, the golf club shaft has a torque value that is not higher than 6.5 degrees, proportions in mass of bias oriented fiber prepreg layers at a tip end portion, a central portion, and a butt end portion satisfy the relationship:

tip end portion<central portion≤butt end portion, and the prepreg layers within a range of 300 mm from the tip end comprise 15 to 25 mass % of prepreg layers that contain pitch-based fiber and 75 to 85 mass % of prepreg layers that contain PAN-based fiber.

2. The golf club shaft according to claim 1, wherein the prepreg layers that contain PAN-based fiber include layers having straight oriented fiber at 0° containing the PAN-based fiber in an amount of not less than 50 mass % and layers having bias oriented fiber at 45° containing the PAN-based fiber in an amount of not less than 15 mass %.

3. The golf club shaft according to claim 1, wherein the proportions in mass of bias oriented fiber prepreg layers at the tip end portion, the central portion, and the butt end portion fall within the ranges of 20 to 35 mass %, 30 to 45 mass %, and 30 to 45 mass %, respectively.

4. The golf club shaft according to claim 1, wherein the torque is not lower than 3.0 degrees.

5. A golf club shaft having a tip end, a central portion, and a butt end that is formed from multiple carbon fiber prepreg sheets wound to form layers each having straight or bias oriented fibers wherein, if a distance from the tip end of the shaft to a center of gravity of the shaft is $L_G$ and if the full length of the shaft is $L_S$, then the relationship $0.54 \leq L_G/L_S \leq 0.65$ is satisfied, the golf club shaft has a weight that is not larger than 55 g, the golf club shaft has a torque value that is not higher than 6.5 degrees, and the prepreg layers within a range of 300 mm from the tip end comprise prepreg layers that contain PAN-based fiber and that include layers having straight oriented fiber at 0° containing the PAN-based fiber in an amount of not less than 50 mass % and layers having bias oriented fiber at 45° containing the PAN-based fiber in an amount of not less than 15 mass %.

* * * * *